US005802799A

United States Patent [19]

Thuleskär et al.

[11] Patent Number: 5,802,799

[45] Date of Patent: Sep. 8, 1998

[54] GLAZING SYSTEM FOR BUILDINGS

[75] Inventors: Börje Thuleskär, Lysekil; Jerker Lundgren, Göteborg, both of Sweden

[73] Assignee: Scandinavian Licence AB, Sweden

[21] Appl. No.: 640,850

[22] PCT Filed: Nov. 9, 1994

[86] PCT No.: PCT/SE94/01055

§ 371 Date: Jun. 17, 1996

§ 102(e) Date: Jun. 17, 1996

[87] PCT Pub. No.: WO95/13439

PCT Pub. Date: May 18, 1995

[30] Foreign Application Priority Data

Nov. 10, 1993 [SE] Sweden ..... 9303704

[51] Int. Cl.[6] ..... E04C 2/38

[52] U.S. Cl. ..... 52/656.5; 52/235; 52/656.9; 52/204.597; 52/204.591

[58] Field of Search ..... 52/204.1, 235, 52/656.5, 656.7, 656.9, 204.591, 204.597, 204.595, 204.599

[56] References Cited

U.S. PATENT DOCUMENTS

| | | | |
|---|---|---|---|
| 4,608,793 | 9/1986 | Yost et al. | 52/204.597 X |
| 4,803,817 | 2/1989 | White et al. | 52/235 |
| 4,912,898 | 4/1990 | Holmes | 52/235 |
| 5,381,637 | 1/1995 | Farag | 52/204.597 X |
| 5,592,795 | 1/1997 | Rinehart et al. | 52/204.591 X |

*Primary Examiner*—Carl D. Friedman
*Assistant Examiner*—Yvonne Horton-Richardson
*Attorney, Agent, or Firm*—Lerner, David, Littenberg, Krumholz & Mentlik

[57] ABSTRACT

Glazing system in buildings for facades, roofs, glass enclosures and windows for example and comprising glass elements with at least two glass panes (3, 4) joined at a distance from one other. The panes are connected in the form of a frame along certain edge areas at a distance from these, so that tracks extending inwardly from the edges are formed between the panes. The elements are intended to be mounted on a framework comprising framework elements (15) with portions (16) for contact of the elements during fastening to the framework by means of fastening elements (18) extending in said track. Where the fastening elements are to be positioned, protector elements. (7) are arranged having both a U-shaped portion, which is arranged to surround the edge of the glass pane (4) facing the framework, as well as an extra flange (6) which extends in the track and connects to the U-shaped portion so that a space is formed for a portion of the fastening element (18). This part extends in the track from a connection (19) with the framework positioned outside the edge of the pane (3). Both the flanges of the strip for the U-shaped portion of the strip positioned outside the pane hereby provide a lining between the pane and the framework and the fastening element (18) respectively when they are pressed against the pane.

8 Claims, 5 Drawing Sheets

GLAZING SYSTEM FOR BUILDINGS

FIELD OF THE INVENTION

The invention relates to a glazing system for facades, glass enclosures, roofs and windows. The glazing system is of the type in which the glass elements consist of glass panes in several layers, so-called insulated glass, and where the elements on the outside are joined edge to edge with an intermediate joint compound but generally without any outer frame element.

STATE OF THE ART

A glazing system of this type is known from DE-A1-3439436 (Schüco). In this the elements consist of two panes of glass which are joined around a distance strip by means of a sealing compound adhering to the glass surfaces. Outside of this joint the glass panes extend outwardly a short way, whereby a track is formed between the panes all around the glass element. The panes are attached to a supporting beam framework by one of the attachment elements being inlaid into said track and pressed in towards the edge of the inner glass pane by means of a screw connection with the framework. In this way the inside of the inner pane is pressed towards support battens on the framework which are located directly opposite said distance strip.

With this construction, the edge of the inner pane will be subjected to a bending moment when the attachment element is pressed towards the edge at the same time as the glass pane, at a distance from this, is pressed towards the framework. This results in a risk of breakage of the glass pane, so that the attachment by means of the attachment element is lost. A further disadvantage is that the glass edges on the element are unprotected when this is handled separately for assembly. This results in a large risk of damage during its handling even if the panes are of toughened glass since such are particularly sensitive to being struck on the edge.

Another glazing system is known from DE-A1-3626194 (Schüco). In this the attachment of the glass elements occurs in that attachment elements have been glued to these with a joint compound. The attachment elements are, in turn, attached to the framework by means of screw connections. With such a construction, the risk arises that the glue connection between the attachment element and the glass element will loose strength, whereby it has happened that glass elements have loosened and fallen down from the facade. Moreover the attachment elements are large and bulky since they have to extend a longer distance along the glass edge in order that the glue connection will have sufficient strength.

SUMMARY OF THE INVENTION

With the system according to the invention, the attachment occurs by means of attachment elements of limited size screwed to the framework, said elements being pressed towards the glass edge of the innermost pane directly facing support surfaces arranged on the framework. In this way no bending forces occur in the edge of the glass pane. Moreover a protector against knocks at the edge of the glass during separate handling is provided, said protector constituting at the same time a lining in the attachment joint.

Additional advantages will be clear from the following description of a preferred embodiment and additional features of the invention are defined in the appended claims.

DESCRIPTION OF THE FIGURES

Two variations of a preferred embodiment of the invention will now be described with reference to the accompanying drawings in which.

PREFERRED EMBODIMENT

Figure 1:
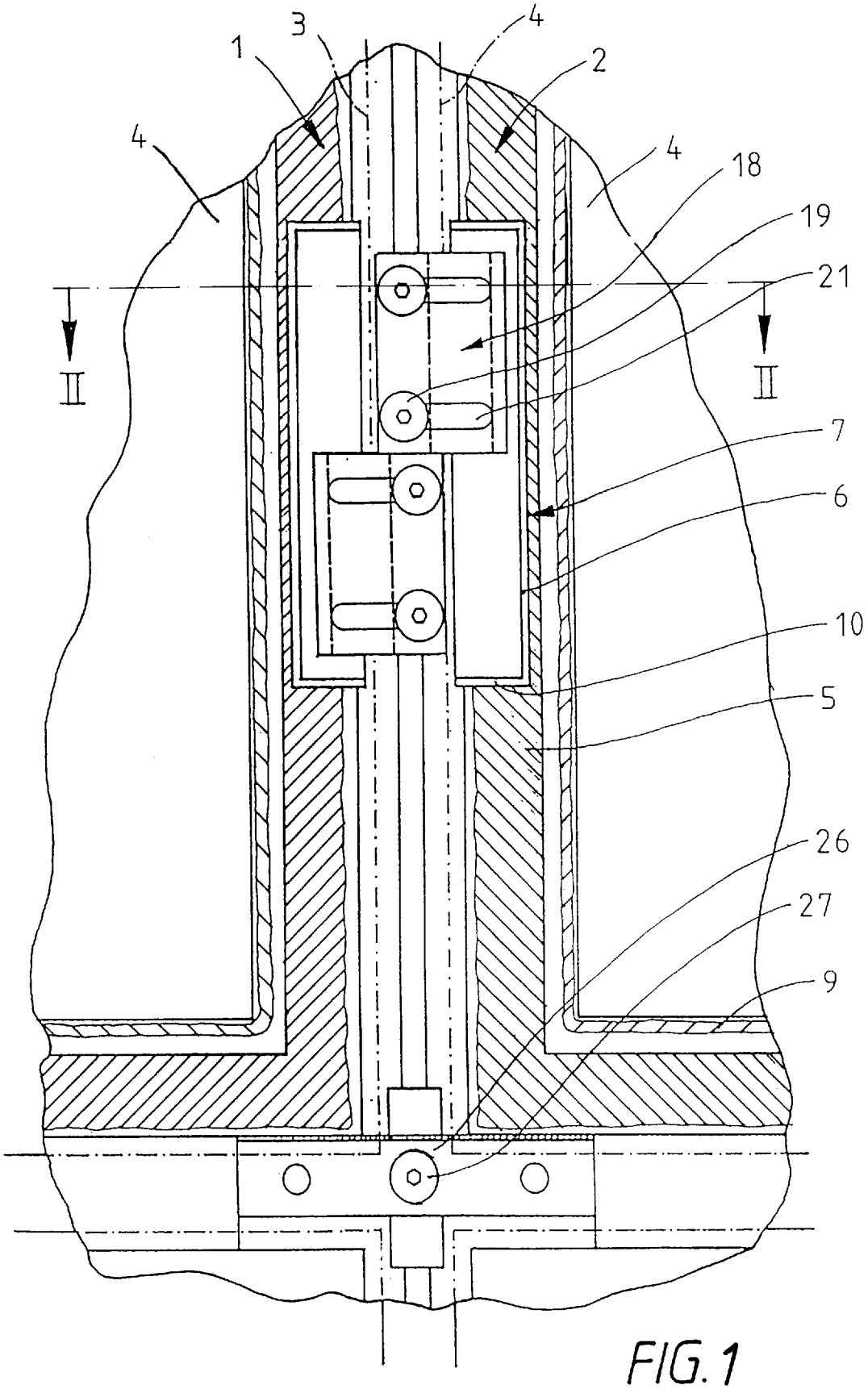
FIG. 1 shows a partial view of the two meeting edges close to the corners of two glass elements, which are attached to a vertical beam of a framework, whereby certain parts of the glass elements are sectioned along the line I—I in FIG. 2.
Figure 2:
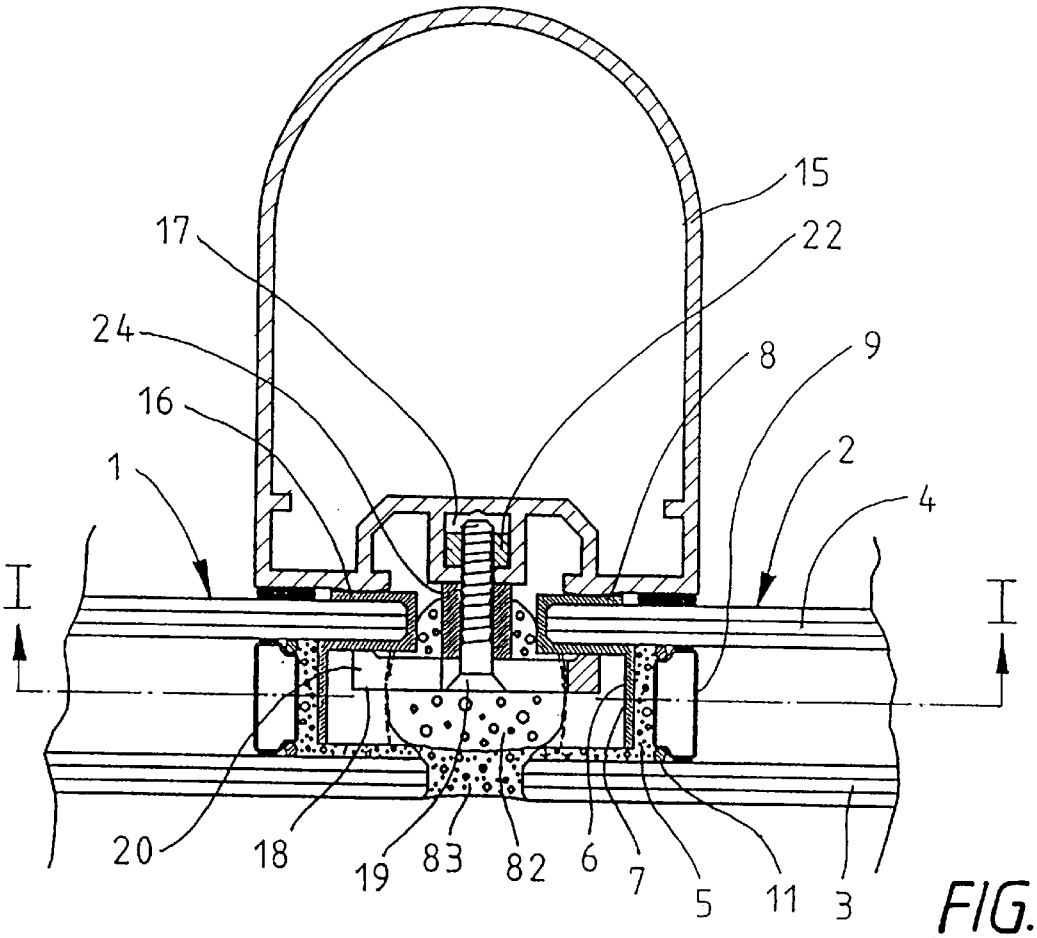
FIG. 2 shows, in horizontal section, the two meeting edges of the glass elements along line II—II in FIG. 1.

FIGS. 1 and 2 show the edges of two fixed glass elements 1 and 2. Each of these consists of an outer glass pane 3 and an inner glass pane 4 (in FIG. 1, the pane 3 has been partially cut away and its edge is shown with a chaindotted line). A distance strip 9, which forms a frame around the preferably quadratic or rectangular glass elements gives an insulated gas-space between the panes. In this way a so-called insulated pane is formed.

The space can be divided into several compartments by means of intermediate glass panes for improvement of the insulation effect. Outside of the respective distance strips, a joint compound 5 with high adherence characteristics to glass is inlaid, for example silicon, and outside of this, in turn, a flange 6 extends to a tray-like protector element 7 which, with a U-shaped portion 8, extends around the edge of the inner pane 4. At the ends of the elements the flange is terminated by end walls 10. The intention is that the strip 7 should be pushed in over the edge of the pane after the joint compound 5 has been added, whereby the flange 6 of the strip pushes the joint compound aside towards the strip 9, but at the same time allows, due to the fact that the U-shaped portion is somewhat shorter than the distance from the edge of the pane 4 to the strip 9, a layer of joint compound to be formed between the panes. The joint compound 5 should form a seal around the frame which is formed by the strip 9 and at the same time constitute an adhesive connection between the panes. For sealing, sealing rings 11, additional sealing strips and/or complementary joint compounds with particularly high diffusion sealability to gases can additionally be arranged.

The framework, which the glass element is to rest against with its edges and be fastened to, is represented by a vertically running beam or column 15. This presents two attachment portions 16 for the glass elements as well as an intermediate portion with space for a screw connection. This is represented by a track 17 in the mid-portion, in which a number of nuts 22 in the form of strips have been inserted.

How the framework element 15 should appear in other respects can be freely determined, basically without regard to the glazing system. For attachment of glass elements 1 and 2 a number of fastening elements 18 are arranged along their vertical edges, said fastening elements being fastened to the mid-portion 17 of the beam 15 by means of screws 19 which are in threaded engagement in said nuts 22. The fastening elements 18 are formed as plates with strip-formed projections 20 along those outer edges which face inwardly towards the inner glass pane 4. Holes 21 are arranged for the screws 19. The projections 20 can alternatively be formed with a cylindrical surface instead of the more angular shape according to FIG. 2. FIG. 1 shows that each of the fastening elements only extends in one direction with its outer edge and is thereby laid with every second element against the edge of one of the glass elements and the other against the edge of the other glass element. It is clear that the holes 21 are elongated so that before the screws are tightened, the elements can be displaced from a position between the glass edges to an attachment position which is shown in FIGS. 1 and 2. The holes 21 are finished at one end with a conical countersink so that when the elements take up the depicted attachment position and the screws are tightened, the elements will be secure against displacement since the conical screw-head is screwed into the conical recess.

This presupposes that the attachment elements 18 are made from hard material for reasons of durability, preferably of steel/metal. The beam 15 is also presupposed to be made of such a material, for example extruded aluminium. The element 7 is between the glass and the projections 20 and it is assumed that this is made of relatively hard plastics. The strip supplies the contact pressure not only between the attachment element and the glass but also between the glass and the contact portions 16 of the beam. There is also a somewhat springy plastic block 24 between the attachment element and the beam. The blocks 24 form an adapted distance piece between the beam and the respective fastening elements.

As is clear, in particular from FIG. 2, the attachment elements 18 are formed with a projection 20 at one end, which on the side facing towards the protector element 7, have the form of a strip which gives a defined position for the pressure surface between the attachment element 18 and the protector element 7. In the same way, a defined pressure surface is obtained where the protector element 7 lies against the somewhat-projecting contact portions 16 of the framework element 15. These positionally defined pressure surfaces are placed opposite each other so that the intermediate glass is not subjected to any bending stresses but only pressure. Such a definition of the position of the pressure surfaces can alternatively be achieved by projections on the protector elements 7 as an alternative or a complement to the above-described projections.

The outer view in FIG. 1 shows how the lower edges of both glass elements 1 and 2 rest against a support element 26 fixed at the beam 15 by means of screw connections 27.

As can be seen, the strip 9 also continues along the horizontal edge of the element and the joint compound 5 is inlaid between the glass panes. There are no protector elements 7 along the horizontal edge and the joint compound can therefore have the same thickness along the whole edge. In a similar way to that in which the joint compound body 5 is shown in FIG. 1, this can also be performed along the vertical edges in the locations where no fastening element 18 is to be arranged and thus does not require the space which is formed by the protector, elements 7. Since the joint compound then has a larger extent, a greater strength is obtained in the adhesive connection which the compound forms between the panes.

Figure 3:
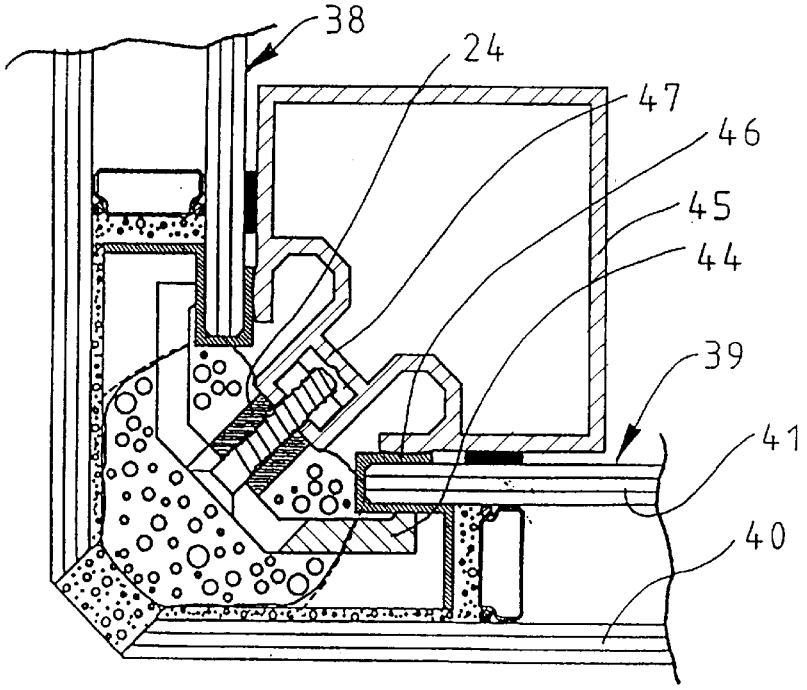
FIG. 3 shows, in horizontal section, how the elements can be arranged and attached to the framework in a corner of a building.

FIG. 3 shows how an outer corner can be arranged. The glass elements, here 38, 39 basically have the same design as described in connection with FIG. 1 and 2. One difference is however that the outer pane, here 40, is extended by such an amount with respect to the inner pane, here 41, in order to allow a suitable gap to be formed between the two outer panes of the elements for sealing with joint compound. Exactly how long the overlapping portion should be depends on which angle the corner has, that shown here being a 90° -angled corner.

The fastening elements, here 44, are also angularly adapted as are the contact portions 46 of the vertical beam, here 45. The middle portion 47 of the beam basically has the same design as in FIGS. 1 and 2 and it also has the screw connection and its distance piece 24.

Figure 4:
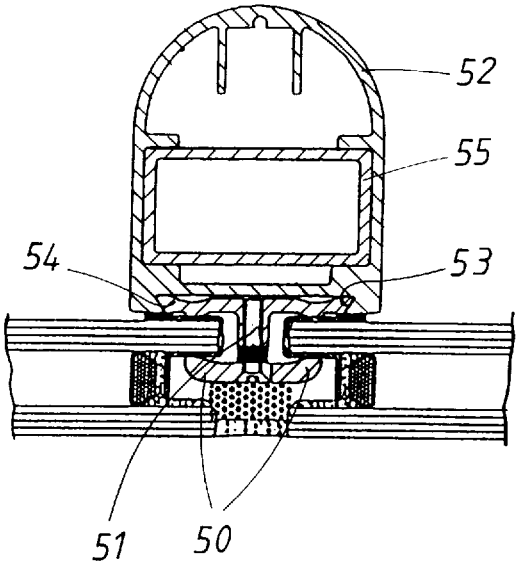
FIG. 4 shows a second variant in horizontal section.

FIG. 4 basically shows the same construction as shown in FIG. 2, although there is a difference in that the attachment elements, here 50, are not secured by the attachment screw, here 51, having a direct attachment into the framework element, here 52. The framework element 52 is instead provided with a dovetail track 53, in which a strip-formed intermediate element 54 is inserted. The intermediate element is provided with a thread, into which the screw 51 can be screwed.

It is assumed that the framework element 52 is extruded from lightweight-metal. In order to obtain additional stiffness, it is shown in FIG. 4 that this is provided with an inserted rectangular tube 55 which is suitably made of steel.

Figure 5:
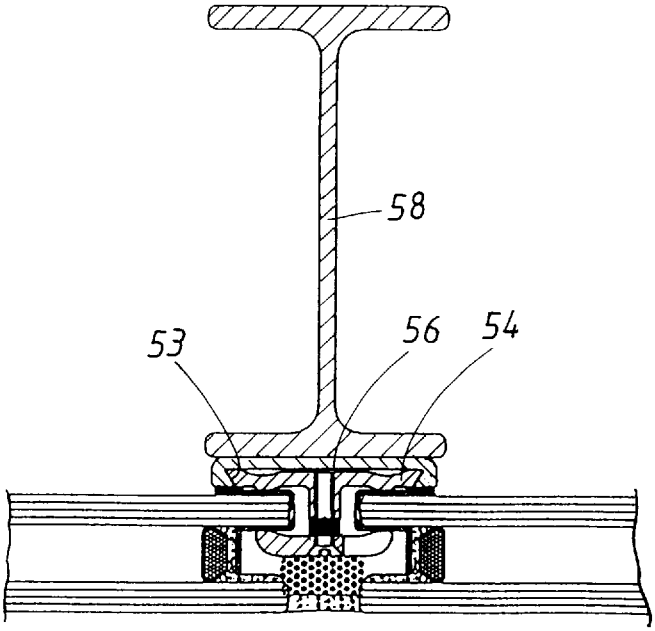
FIG. 5 shows the second variant in vertical section.

The use of the intermediate element is also shown in FIG. 5, said intermediate element also being denoted 53 in FIG. 5. This is not attached in any framework element, but in a separate batten 56, the task of which is to allow the attachment of the intermediate element 53 to framework elements of different types. These do not have to be specially designed in order to fit the system; in FIG. 5 the attachment to an I-beam 58 is shown. The attachment of the batten can be made with screws for example. For a framework element which does not have a planar side for attachment of the batten 56, this can be formed in a different way in order to be adapted to each type of framework element.

FIGS. 4 and 5 are vertical sections similar to FIG. 2 and thus show an upright framework element. There may also be horizontal framework elements directly in front of the horizontal joints between the glass elements. They can be used for reasons of support if this is preferred instead of the upright supporting framework element. Horizontal elements can also be used as a complement to the upright ones either in order to obtain extra attachment force, for example with very long glass elements or if it is desired to seal the joints between the glass elements from the inside.

Figure 6:
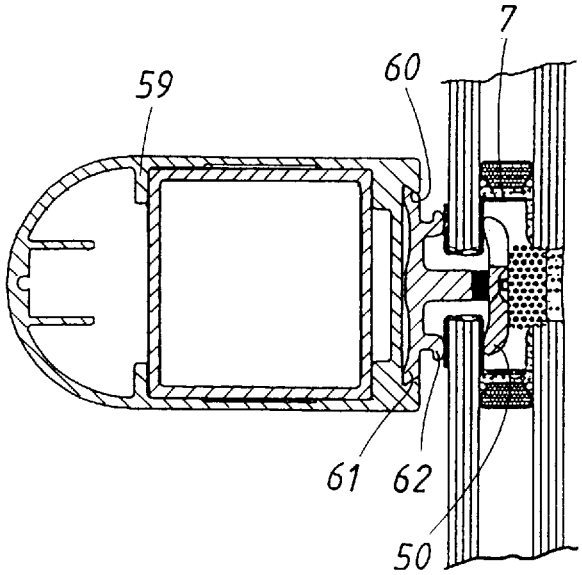
FIG. 6 shows a horizontal section of the edges of two glass elements which are attached onto beams at a distance from a supporting facade structure.

FIG. 6 shows such a horizontal framework element 59 which, as described previously, has a dovetail track 60. An intermediate element 61 is inserted into this, said intermediate element functioning as an attachment for the attachment elements 50.

The intermediate element 60 however differs from the intermediate element 54 in that the contact surface for the glass element's protector element 7 is formed on a projecting shoulder 62, behind which a channel is formed. This can be used for collection of condensation water which is thereby conveyed up to a vertical joint where the water can be taken care of for further downward conveyance. The batten 61 is shown here as being symmetric with the channel-forming shoulders both upwardly and downwardly. However for drainage of condensation water only an upwardly-directed channel can be used of course.

Figure 7:
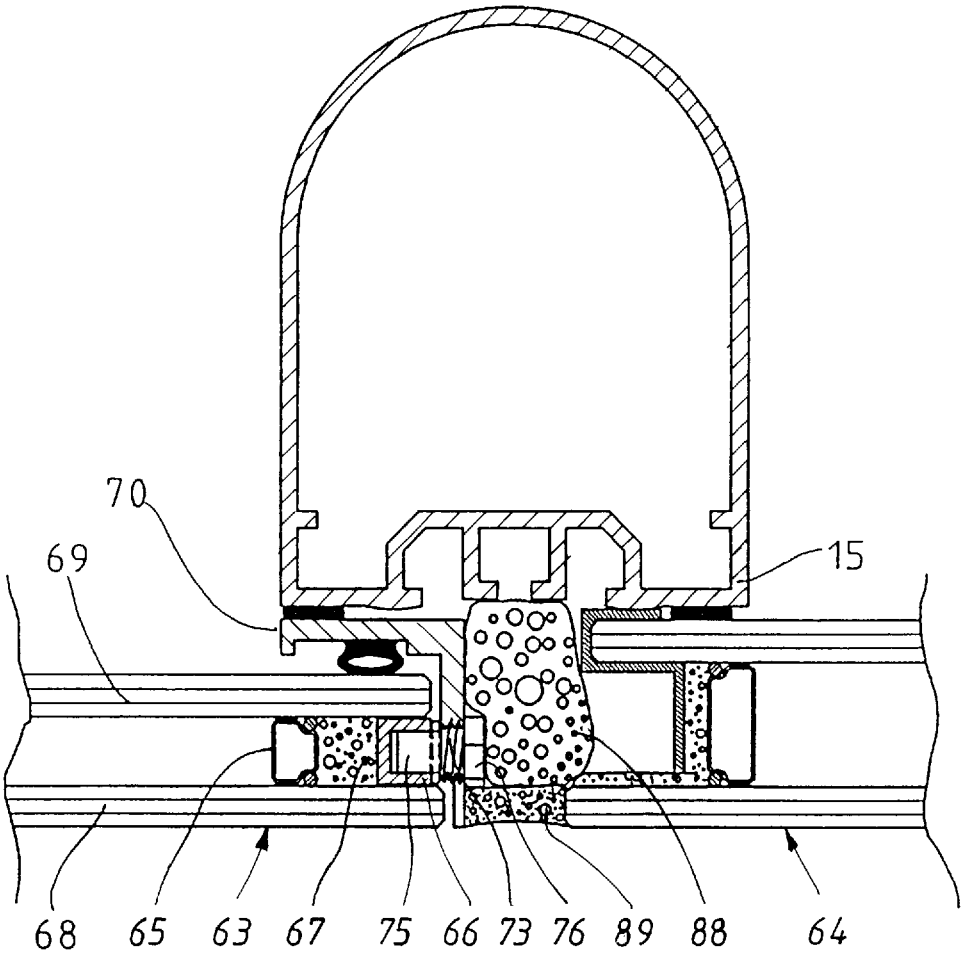
FIG. 7 shows an edge area in horizontal section corresponding to the section in FIG. 2, where a fixed glass element is connected to a pivotable glass element which forms an openable window.
Figure 8:
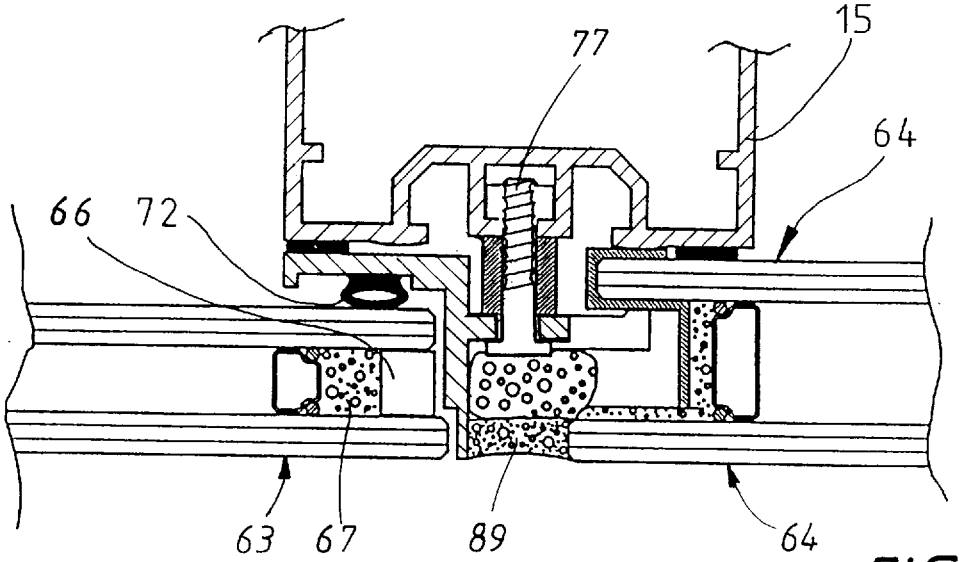
FIG. 8 shows the same edge area, but in horizontal section below that shown in FIG. 7.
Figure 9:
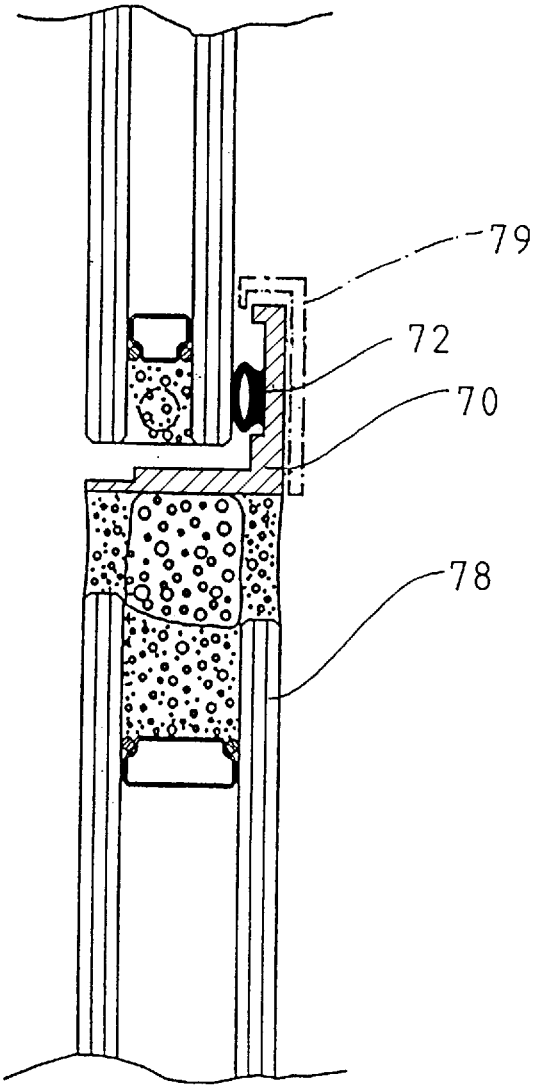
FIG. 9 shows a vertical section of an area where the openable window meets an underlying fixed glass element at its lower edge.

FIGS. 7, 8 and 9 show the connection between an openable window 63 and fixed surrounding glass elements. The window is in a plane with the fixed surrounding glass elements of the facade. In FIGS. 7 and 8 which are horizontal sections, a fixed element for connection from the side is denoted 64 and this has the same design and manner of attachment as described previously. The openable window element 63 is provided with a frame strip 65 which is narrower than the strip 9. For absorbing the forces arising from a hinged support and in order to be able to resist the bending forces which can occur with an unconstrained glass element, the window element is provided with an additional strip 66. This can form a frame with four sides or alternatively be formed without the upper side so that it forms a U, or it may even only consist of two parallel pieces. Even here, joint compound 67 is present between the outer glass pane 68 and the inner 69 as well as extending between the strips 65 and 66.

A frame section 70 is arranged to be attached to the framework beam 15 with a screw connection 71 (see FIG. 8) by making use of the attachment locations which are used with fixed glass elements for the attachment of these. Sealing strips 72 are arranged between the glass element 64 and the frame section 70, said strips being fixed to the abutting edge of the frame section. The strip 72 cooperates with the inwardly-facing surface of the inner glass pane 69 around its edge.

It is also clear from FIG. 7 that the frame section 70, at the upper edge, is provided with recesses for hinge pins 75 each of which is threaded via its shaft into the side part of the strip 66. The pins have heads 76 with key attachment formations. In this manner the top-hung window thus-formed can be swung outwardly. On the upper edge, outer sealing is provided for by means of an L-shaped strip (not shown) with a pliable outer tongue which can flex outwardly upon outward swinging of the glass element and, with its edge, thereby follow the outer surface of the same for sealing. The sealing strip 72 provides for the inner sealing at the upper and lower edge of the window just as it does at the sides.

FIG. 8 shows a horizontal section underneath the section passing through the hinge pins in FIG. 7. If the window is made as a casement window, the view in FIG. 8 can be seen as a vertical section.

From the vertical section in FIG. 9 it is clear that the frame section 70 also extends along the lower edge of the window.

FIG. 9 shows the lower edge of the openable window, where it connects to the underlying fixed glass element 78. The underlying side of the frame section 70 is also shown, as is the sealing strip 72. The lower side of the frame section is supported by the side parts of the frame section, said side parts being fixed to the framework as is shown in FIGS. 8. FIG. 9 indicates also how the frame section can be provided with a cover 79 applied for decorative reasons and/or in order to heat-insulate the frame section which is preferably made of metal on the inside.

When mounting a glass element, a suitable number of attachment elements 18 are put up, along the vertical beams 15 which will be located at the side edges of the element, with the help of the screws 19 (FIG. 2) threaded into the nuts 22 in the track 17 of the beam. The fastening elements are brought into the described outwardly displaced position. The support elements 26 (FIG. 1) are also put up where the lower edge of the element is to be positioned.

The element should be pre-mounted in the condition which has been described with the glass panes held together around the strip 9 by joint compound 5 (FIG. 2) as well as with the protector elements 7 placed where the fastening elements will be positioned at the side edges of the element.

When putting up the element, the element is supported with its lower edge against the support batten 26 (FIG. 1). After swinging into place, the portion 8 of the protector element 7 will contact one portion 16 of the vertical beam 15. The fastening elements 18 are then displaced inwardly to grip over the edges of the inner pane as shown in FIG. 2.

The screws 19 are now screwed down with their heads into the conical countersink in the fastening element and screwed in, in order to tighten its edge strips 20 against the inner glass pane via the protector element 7. A preparatory sealing between the mounted elements is now effected by inlaying a foamed material 82 in the space between the adjacent glass elements (see FIG. 2). The joints between the elements are finally sealed with a weather-proof joint compound 83, for example silicon. By means of the foamed material 82 which can be an inserted strip or a strip foamed in-situ, a soft filling with a small material content is obtained, which forms a support for the joint compound 83 which has high density and prevents this from spreading into the larger space during its insertion.

The putting-up of the glass elements in the alternative embodiment according to FIG. 4 occurs in the same way as has been described with reference to FIG. 2. This is also true for the embodiment according to FIG. 5. The depicted deep I-beam can thereby be used in order to attach glass elements at a distance from the facade if this lies behind the inner flange of the I-beam 58. Other types of framework element can also be designed which replace the shown I-beam in order to obtain any particular desired placement of the glass elements with respect to the supporting structure. This means that the system according to the invention can also be used for direct glazing of a facade and even for building up glass walls and roofs. The intermediate element 54 in the embodiment shown in FIGS. 4 and 5 or in other embodiments thereby allows all possibilities for the design of the supporting structure.

With the openable window, the frame-shaped edge section 70 is first put up in the described manner with the aid of screws 77 (FIG. 8). The empty space up to the surrounding fixed elements is then filled up with foam bodies 88, whereafter final sealing occurs with joint compound 89.

This occurs all around the frame section (compare to FIGS. 7, 8 and 9).

With this assembly description and with the support of the description of the earlier arrangement it should be clear how the other described parts and varying components of the system are assembled.

Further variations of the system can be performed within the scope of the appended claims for adapting to different installations and for use as facade systems, glass enclosure systems, roofs and window-sets etc.

Important elements of the system according to the invention are the protector elements 7. Space for the fastening elements during assembly of the insulated pane is easily achieved with these since when the protector elements are brought into place, the joint compound is pushed aside before it has hardened. Where no such space is required, the joint compound can extend further out towards the glass edge and thereby obtains a large attachment surface which increases the forces holding the glass together. Moreover the protector elements, with their U-shaped parts, form a lining both for the framework and the fastening elements so that no contact between glass and metal occurs. By use of a suitable plastic material in the protector elements, the contact forces can be sufficiently taken up and a certain elasticity obtained, which evens out the stresses. The bottom of the U-shaped part lastly forms a knock protector at the glass edge when the glass element is handled during transport and assembly.

It is also very advantageous with the main embodiment according to FIGS. 1 and 2 and also FIG. 3, that the fastening elements 18 and 44 respectively together with the contact portions 16 and 46 respectively of the framework are so formed that the contact pressure line for the fastening elements is positioned directly in front of the contact portions of the framework, measure perpendicularly to the glass surfaces. In this way the glass in the inner pane 4 and 41 respectively is only subjected to compression forces in its mounting and not to any bending forces as would arise if the contact lines of the fastening elements and the framework respectively were offset with respect to one another.

Additional advantages are achieved by means of the displaceability of the fastening elements so that they can be pre-mounted but still, in a downwardly displaced position, allow the putting-up of the respective glass element. After this, the fastening element can be brought into the fastening position and be secured in this by means of the said arrangement of screw holes. The assembly is furthermore facilitated in that the glass element is supported by the support elements arranged along its lower edge and therefore does not need to be fastened in a "floating" position before the attachment has occurred.

We claim:

1. A glazing system for buildings, comprising:

at least one glass element with an inner glass pane and an outer glass pane, said glass panes having respective pane edges and having respective facing surfaces substantially parallel to and spaced apart from each other; said inner and outer panes further having respective second surfaces opposite said respective facing surfaces;

each of said at least one glass elements having a respective frame interposed between said facing surfaces and spaced away from said edges of said panes, said panes having edge portions between said edges and said frame, said frame and said edge portions defining respective tracks, said tracks for retaining joint compound having an affinity to said facing pane surfaces therein;

a building framework for mounting said at least one glass element, said building framework having at least one resting portion for contacting said second surfaces of said edge portions of said inner glass panes;

fastening elements extending over said edge portion of said facing surface of said inner glass pane into said respective tracks;

said attaching elements connecting said fastening elements to said framework, said attaching elements urging said fastening elements against said edge portion of said facing surface of said inner glass pane so as to press said edge portion of said second surface of said inner glass pane against said at least one resting portion of said framework; and U-shaped protector elements on said edge portion of said inner glass pane at positions of said respective fastening elements, said protector elements comprising U-flanges for protecting said edge portion of said inner glass pane at said positions of said fastening elements.

2. A glazing system as claimed in claim 9, wherein said protector elements further comprise extra flanges extending from one of said U-flanges substantially from said inner pane to said outer pane and positioned between a respective one of said fastening elements and said frame, whereby said extra flanges limit an extension of said joint compound into said position of said respective fastening element, whereby said joint compound can extend close to said edges of said panes in areas outside said positions of said fastening elements to provide a large contact area between said joint compound and said panes.

3. A glazing system as claimed in claim 2, wherein said protector elements further comprise end walls extending in said trace in a traverse direction with respect to said tracks, whereby said body of joint compound is prevented from encroaching over said flanges, and said position of said respective fastening element is kept substantially free of joint compound.

4. A glazing system as claimed in claim 1, wherein said fastening elements further comprise contact portions for pressing on said inner glass pane, said contact portions positioned substantially directly across said inner glass pane from said resting portions of said building framework.

5. A glazing system as claimed in claim 1, wherein said attaching elements connect said fastening elements to said building framework in first and second states of connection;

wherein in said first state of connection said fastening elements are displaceable between a position outside said track and a position within said track proximate said edge portion of said inner glass pane, and wherein in said second state of connection said fastening elements are pressed against said inner glass pane, whereby said inner pane is pressed against said framework, and said protector element forms a lining between said fastening element and said inner pane and between said inner glass pane and said framework.

6. A glazing system as claimed in claim 4, wherein said inner glass pane is clamped between said contact portions of said fastening elements and said at least one resting portion of said framework, said at least one resting portion of said framework being defined in its position by projections of said framework and said contact portion of said fastening element being defined in its position by projections of said fastening element, said contact portions of said fastening elements being directly in front of said resting portion of said framework in a direction substantially transverse to said surfaces of said panes, whereby said inner pane is subjected primarily to pressure forces and not to bending forces.

7. A glazing system as claimed in claim 1, further comprising at least one openable window connected to at least one respective hinge framework section; said at least one hinge framework section connected to said building framework by additional ones of said attaching elements, whereby said building framework is connectable both to said fastening elements for attaching said at least one glass element and to said hinge framework sections for attaching said at least one openable window.

8. A glazing system as claimed in claim 7, wherein said at least one openable window comprises an inner glass pane and an outer glass pane, said glass panes having respective pane edges and having respective facing surfaces substantially parallel to and spaced apart from each other; said openable window further comprising a strip-shaped element between said panes near said edges and a body of joint compound between said panes and within said strip-shaped element, for holding said panes together, said at least one openable window being connected to said hinge framework section by bearing shafts, said bearing shafts engaging said strip-shaped element.

* * * * *

UNITED STATES PATENT AND TRADEMARK OFFICE

CERTIFICATE OF CORRECTION

PATENT NO. : 5,802,799

DATED : September 8, 1998

INVENTOR(S) : Thuleskär et al.

It is certified that error appears in the above-identified patent and that said Letters Patent is hereby corrected as shown below:

Column 2, line 32, "chaindotted" should read --chain-dotted--.

Column 3, line 64, delete comma.

Column 5, line 52, "FIGS." should read --FIG.--

Column 7, line 65, "9" should read --1--.

Column 8, line 11 "trace" should read --tracks--.

Signed and Sealed this

Twelfth Day of January, 1999

*Attest:*

*Attesting Officer*

*Acting Commissioner of Patents and Trademarks*